US008267756B2

(12) United States Patent
Klemm et al.

(10) Patent No.: US 8,267,756 B2
(45) Date of Patent: Sep. 18, 2012

(54) EXTRACTION HOOD AND METHOD FOR THE SUCTION EXTRACTION AND/OR PURIFICATION OF CONTAMINATED CARRIER SUBSTANCES

(75) Inventors: Jochen Klemm, Zizur Mayor (ES); Gert Meinhardt, Gondelsheim (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 21 days.

(21) Appl. No.: 10/928,220

(22) Filed: Aug. 27, 2004

(65) Prior Publication Data

US 2005/0051158 A1 Mar. 10, 2005

Related U.S. Application Data

(63) Continuation of application No. PCT/EP03/01582, filed on Feb. 17, 2003.

(30) Foreign Application Priority Data

Feb. 27, 2002 (DE) ..... 102 08 488

(51) Int. Cl.
*F24F 13/28* (2006.01)
*F24C 15/20* (2006.01)

(52) U.S. Cl. ..... 454/49; 126/229 F; 126/299 R

(58) Field of Classification Search ..... 454/49, 454/56–59; 126/299 F, 299 R, 299 D
See application file for complete search history.

(56) References Cited

U.S. PATENT DOCUMENTS

| | | | | | |
|---|---|---|---|---|---|
| 2,886,124 | A * | 5/1959 | Scharmer | 96/121 |
| 3,383,841 | A * | 5/1968 | Olson et al. | 55/337 |
| 3,811,250 | A * | 5/1974 | Fowler, Jr. | 96/422 |
| 4,040,042 | A * | 8/1977 | Mayer | 454/340 |
| 4,685,385 | A * | 8/1987 | Rich | 454/52 |
| 5,170,673 | A * | 12/1992 | Ahmed et al. | 73/865.9 |
| 5,394,861 | A * | 3/1995 | Stegmaier | 126/299 D |
| 6,044,838 | A * | 4/2000 | Deng | 126/299 D |
| 6,142,142 | A * | 11/2000 | Woodall et al. | 126/299 R |
| 6,293,983 | B1 | 9/2001 | More | |
| 6,534,021 | B1 * | 3/2003 | Maus | 422/180 |
| 6,634,939 | B2 * | 10/2003 | Johnson | 454/238 |

FOREIGN PATENT DOCUMENTS

| | | |
|---|---|---|
| DE | 1 454 643 | 3/1969 |
| DE | 1 679 553 | 3/1972 |
| DE | 7412390 | 7/1974 |

(Continued)

OTHER PUBLICATIONS

WO/2001/056624 Document is Atached.*

*Primary Examiner* — Steven B McAllister
*Assistant Examiner* — Helena Kosanovic
(74) *Attorney, Agent, or Firm* — James E. Howard; Andre Pallapies

(57) ABSTRACT

An extractor hood is used for extracting and/or purifying a carrier that is contaminated with solid and/or liquid substances. In order to improve the extraction and/or purification output of an extractor hood and simultaneously to reduce the amount of maintenance required, the extractor hood uses a pre-filtering unit disposed upstream of the filter unit, whereby at least already a partial flow of the carrier to be extracted and/or to be purified is purified to a certain degree already before it reaches the filter unit that is configured as the main filter.

28 Claims, 1 Drawing Sheet

FOREIGN PATENT DOCUMENTS

| | | | |
|---|---|---|---|
| DE | 27 49 824 | A1 | 5/1978 |
| DE | 100 04 558 | A1 | 8/2001 |
| EP | 0 726 424 | A2 | 8/1996 |
| EP | 1 239 226 | A2 | 9/2002 |
| GB | 1 591 451 | | 6/1981 |
| JP | 63-129150 | | 8/1988 |
| JP | 4-27344 | | 3/1992 |
| JP | 4-95242 | | 8/1992 |
| JP | 4-319310 | | 11/1992 |
| JP | 5-231683 | | 9/1993 |
| JP | 6-18836 | | 3/1994 |
| JP | 6-40744 | | 5/1994 |
| JP | 8-219518 | | 8/1996 |
| JP | 9079640 | | 3/1997 |
| JP | 9-222249 | | 8/1997 |
| JP | 10-309419 | | 11/1998 |
| JP | 11-221413 | | 3/1999 |
| JP | 11-257703 | | 9/1999 |
| RU | 1813998 | | 5/1993 |
| WO | WO/01/56624 | * | 8/2001 |

* cited by examiner

EXTRACTION HOOD AND METHOD FOR THE SUCTION EXTRACTION AND/OR PURIFICATION OF CONTAMINATED CARRIER SUBSTANCES

CROSS-REFERENCE TO RELATED APPLICATION

This application is a continuation, under 35 U.S.C. §120, of copending international application No. PCT/EP03/01582, filed Feb. 17, 2003, which designated the United States; this application also claims the priority, under 35 U.S.C. §119, of German patent application No. 102 08 488.2, filed Feb. 27, 2002; the prior applications are herewith incorporated by reference in their entirety.

BACKGROUND OF THE INVENTION

Field of the Invention

The present invention relates to an extraction hood for the suction extraction and/or purification of a carrier substance, in particular air, contaminated with solid constituents, such as, for example, dust, smoke or the like, and/or with liquid substances, such as, for example, water, grease, oil, fumes or the like. The present invention relates, furthermore, to a method for the suction extraction and/or purification of a correspondingly contaminated carrier substance, the contaminated carrier substance being designated hereafter, without the area of application and field of use of the invention being restricted, as vapor.

Extraction hoods have belonged to the prior art for a long time and, for example in a modern kitchen, are in actual fact no longer to be considered as dispensable. They serve there for the suction extraction or purification of the kitchen air laden with steam and/or grease.

Extraction hoods contain, in a basic form, a blower, a hood configured to narrow in the extraction direction and a screen filter covering the blower inlet. As a rule, in these extraction hoods, the flow velocity of the air is highest in the center of the extraction hood. However, particularly due to the lateral escape of vapor, these flow conditions have an adverse effect on the efficiency of the extraction hood. In conventional extraction hoods, therefore, an attempt is made, by a baffle surface disposed on the suction side, to generate zones of higher air velocity in the hood edge region. However, the efficiency of the extraction hood also depends directly on the power of the blower. If the blower has too low a power, there is no guarantee that the kitchen air contained in the hood will be transported away, so that the kitchen air accumulating there flows past the hood edges and is distributed, unfiltered, in the kitchen. In addition, the formation of fumes due to the condensation of the kitchen air cannot be ruled out. A blower of higher power could at least partially rectify this disadvantage, but would also entail a higher noise emission and vibrations and higher prime costs.

Published, Non-Prosecuted German Patent Application DE 1 454 643 proposes a vapor extraction hood, in which zones of higher air velocities are generated at the free edges of the vapor extraction hood, for example by use of a decentral fan configuration or owing to a special configuration of the air routing. In addition, the baffle surface is provided with suction orifices, so that part of the kitchen air can pass through the baffle surface. Although the higher flow velocity generated due to the suction gap in the edge region of the hood prevents the kitchen air from escaping into zones lying outside the cooking area, nevertheless a sooting of the extraction duct and noise nuisance can be reduced only by the use of a filter.

The extraction hood described in Published, Non-Prosecuted German Patent Application DE 27 49 824 has either an air-impermeable or air-permeable baffle surface provided with a leak-tight filter material, in conjunction with edge suction extraction. However, the high fraction of unfiltered air that passes the suction gap and the resultant sooting of the waste-air duct and a noise nuisance caused thereby have an adverse effect.

In the vapor extraction hood which is described in Published, Non-Prosecuted German Patent Application DE 1 679 553 and which likewise has edge suction extraction, the sooting of the waste-air duct and the noise nuisance are reduced in that the entire air stream transported by the blower flows through a filter. Peripheral edge suction extraction is brought about by a suction gap that is formed by a shielding plate following the filter and the inner wall part of the hood. The blower, which allows air suction on both sides, is in this case disposed in the shielding plate in such a way that one air suction side of the blower faces the filter, while the other air suction side is connected to the chamber which is formed by the shielding plate and extends as far as the suction gap and which functions as a vacuum chamber. However, the high flow velocity, which is generated by this configuration in the suction gap, and the very small filter surface available for the air quantity passing through the suction gap lead to a rapid clogging of the filter surface, thus causing a shortening of the maintenance intervals.

Due to the use of at least two filter elements in a kitchen vapor circulating-air hood described in the German Utility Model Specification DE 7412390, an enlargement of the filter surface available in a gap-like supply-air duct located in the region of the hood circumference is achieved. The filter elements are disposed at a distance one above the other, the space located between the filter elements being connected to the suction side of the common blower. However, this technically complicated configuration not only necessitates a disadvantageous overall height, but also prevents operator-friendly handling during maintenance work.

SUMMARY OF THE INVENTION

It is accordingly an object of the invention to provide a extraction hood and a method for the suction extraction and/or purification of contaminated carrier substances which overcome the above-mentioned disadvantages of the prior art devices and methods of this general type, by which a sooting of the waste-air duct and a noise nuisance are avoided and a lengthening of the maintenance intervals of the filter unit is nevertheless made possible.

With the foregoing and other objects in view there is provided, in accordance with the invention, an extraction hood for suction extraction and/or purification of a carrier substance, contaminated with solid and/or liquid substances. The extraction hood contains a housing having at least one inlet and one outlet orifice, and a conveying device conveying the carrier substance through the housing and having an adjustable conveying power. A filter unit is provided through which the carrier substance flows and a shield is disposed upstream of the filter unit on a suction side and is partially permeable to the carrier substance. The shield functions as a prefilter unit.

An extraction hood according to the invention, which can be used, in particular, in kitchen technology, in clean-room technology, at industrial work stations, in the region of machine tools or for air treatment in smokers' corners or the like, has the advantage, as compared with the prior art, that using a shield which precedes the filter unit and which both serves as a baffle surface, which guides part of the carrier substance quantity impinging on it along its edge at which edge suction extraction takes place, and functions as a prefilter unit which can have the flow passing through it horizontally and/or vertically and through which the remaining part stream of the carrier substance to be suction-extracted and/or purified is sucked. The carrier substance is to some degree purified even before it enters a filter unit configured as a main filter. As a result, the filter unit through which the entire carrier substance stream to be suction-extracted and/or purified is sucked is assisted. This has the result not only of avoiding the sooting of the waste-air duct and a noise nuisance, but also of a reduction in the maintenance work due to a lengthening of the maintenance intervals of the filter unit.

The main filter used is a filter unit preferably in the form of at least one surface filter, such as, for example, an expanded-metal filter or nonwoven filter, since, in this, the expanded-metal wires or the fibers are disposed so as to be offset slightly one behind the other, so that the carrier stream has to wind its way through the expanded-metal wires or fibers arranged one behind the other, and constituents, such as, for example, grease droplets, contained in the carrier stream cannot negotiate these deflections on account of their increased inertia and are therefore caught on the wires or fibers and are separated.

According to an advantageous refinement of the invention, the prefilter unit, utilizing the whirling stream technique, has at least one whirling stream filter. The whirling stream filter of this type that is used is, for example, a cyclone, labyrinth or baffle filter. The operation of a cyclone filter, in particular what is known as an "X-cyclone filter", is based on the fact that, by use of flow guide walls, vortices are generated, by which the contaminations, such as, for example, grease droplets, are thrown onto the guide walls, the carrier substance being cleaned of these. A similar behavior is found in labyrinth filters which sharply deflect the air flowing through and at the same time build up compressions and expansions, that is to say velocity variations in the flow, thus bringing about a separation of the contaminations.

According to a further advantageous refinement of the invention, the permeability of the shield to carrier substance, which is generated, for example, by a mechanical variation in cross section of the passages, is adjustable.

According to a further advantageous refinement of the invention, the through flow quantity of carrier substance through the prefilter unit can be adjusted by at least one additional conveying device which is formed, in particular, by a blower. Through flow quantity regulation coupled automatically to the main blower device or manually adjustable brings about an optimization of the efficiency of the prefilter unit.

According to a further advantageous refinement of the invention, an at least partially peripheral suction gap is formed by the shield.

According to a further advantageous refinement of the invention, the quantity of carrier substance that flows through the suction gap can be regulated by varying the suction gap width.

According to a further advantageous refinement of the invention, a filter is likewise disposed in the suction gap, with the result that the carrier substance flowing through the suction gap is also prepurified before it enters the filter unit.

According to a further advantageous refinement of the invention, the permeability of the shield to carrier substance varies as a function of region. In this case, preferably, the carrier substance permeability is configured to be different at an edge region and at a region in the center. Due to the flow conditions generated thereby, it is possible for the efficiency of the prefilter unit to be optimized.

According to a further advantageous refinement of the invention, a screen serving for enlarging the intake region is disposed on the housing.

According to a refinement of the invention that relates to this, the screen if formed of at least partially of transparent material, in particular of a glass or the like. As a result, a restriction of the view of, for example, the cooking area located under the extraction hood is avoided. In addition, the esthetic appearance of the extraction hood according to the invention is enhanced by the visually pleasing configuration and the visible filter technology.

According to a further advantageous refinement of the invention, at least one lighting unit, in particular in the form of at least one halogen emitter, is integrated into the screen, into the housing, into the filter unit and/or into the prefilter unit.

According to a refinement of the invention relating to this, the lighting unit can be dimmed, so that a light output quantity can be adapted to the respective requirements.

According to a further advantageous refinement of the invention, the screen, the filter unit and/or the prefilter unit are disposed obliquely to the housing and/or to an adjacent wall. Due to the oblique configuration of the filter unit and/or of the prefilter unit, these can be used with a larger filter surface. Consequently, the efficiency of the appliance is increased, with the overall depth being virtually the same, and, moreover, a time interval between cleaning operations carried out on the filters is lengthened.

According to a refinement of the invention relating to this, the screen, the filter unit and/or the prefilter unit are configured to be capable of being deflected out of the horizontal position. It is thereby possible to adapt the extraction hood to the respective circumstances, such as, for example, a particularly high contamination of the carrier substance, making it necessary for a cooking area to be covered over a wide range.

According to a further advantageous refinement of the invention, the screen, the filter unit and/or the prefilter unit can easily be removed for cleaning or for exchange. Preferably, these elements are manufactured from dishwasher-proof materials, such as, for example, glass or high-grade steel.

According to a further advantageous refinement of the invention, the conveying device in the form of a blower is integrated in the housing and/or is arranged externally. By use of a selective or even additional external arrangement, the operation of a plurality of extraction hoods by one conveying device appropriately dimensioned in terms of power can also be implemented.

According to a further advantageous refinement of the invention, waste-air or circulating-air operation is made possible by a selection of the outlet orifice.

According to a further advantageous refinement of the invention, the degree of pollution or of saturation of the filter unit, of the prefilter unit and/or of the suction gap filter can be determined by a sensor, measuring detector or the like and is indicated optically and/or acoustically.

According to a further advantageous refinement of the invention, a signal signals fault free operation, a maintenance interval and/or a functional impairment. Straight faults or maintenance intervals are outputted to a user optically and/or acoustically.

In a method according to the invention for the suction extraction and/or purification of a carrier substance contaminated with solid and/or liquid substances, that is to say in a main application of appliances according to the invention, grease-containing vapor from a cooking point, at least a part stream of the carrier substance to be suction-extracted and/or purified passes through a prefilter unit before entering the filter unit. Since this part stream is thus already to some degree purified, a filter unit which is configured as a main filter and through which the entire carrier substance stream is sucked is relieved. As a result, the necessary maintenance intervals are lengthened and a sooting of the waste-air duct and a noise nuisance are avoided.

Other features which are considered as characteristic for the invention are set forth in the appended claims.

Although the invention is illustrated and described herein as embodied in a extraction hood and a method for the suction extraction and/or purification of contaminated carrier substances, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
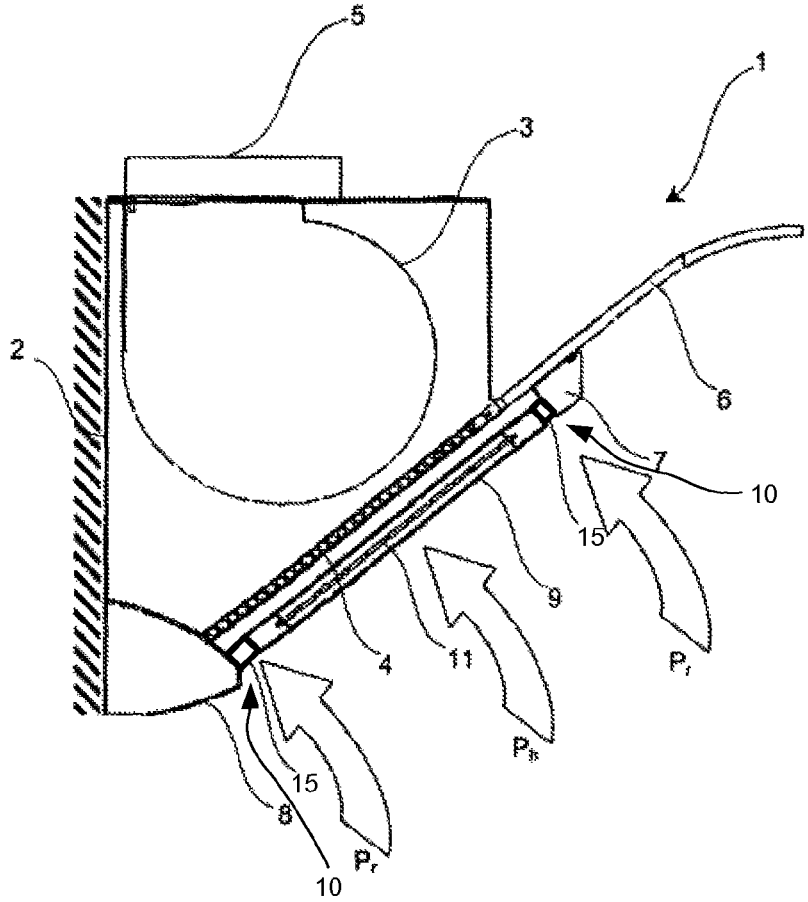
FIG. 1 is a diagrammatic, sectional view of an extraction hood according to the invention in a middle region.

Referring now to the figures of the drawing in detail and first, particularly, to FIG. 1 thereof, there is shown a sectional illustration of an extraction hood 1 according to the invention which is illustrated only in sketched form in order to make clear properties substantial to the invention. By virtue of its high power, along with low overall depth, the extraction hood 1 can be used, in particular, in the kitchen, above machine tools, in smokers' corners or the like.

A blower 3 is accommodated in a housing 2 of the extraction hood 1. By use of the blower 3, the entire air to be suction-extracted and/or purified is sucked through a filter unit 4 preferably configured as a surface filter. The filter unit 4 is configured, here, as an expanded-metal filter 4 formed of high-grade steel, which, if required, can be supplemented by a non-woven filter. After running through the filter unit 4, the air is led through at least one outlet orifice 5. The position of the outlet orifice 5 in this case depends on whether it is a waste-air extraction hood, a circulating-air extraction hood or a combination of the two functional types. In order to enlarge the filter surface, the filter unit 4, which as a main filter is intended to serve, for example, for main grease separation, is disposed obliquely on the housing 2. The filter unit 4 is surrounded by a screen 6. The latter is likewise disposed obliquely, thus ensuring the headroom of the person active at the cooking point or at the machine tool. Advantageously, the screen 6 is manufactured from a transparent material, glass being used in the present exemplary embodiment. Control elements 7 including, for example, of indicating and operating elements are located on the screen 6. What may be envisaged in this case are both pilot lights, warning lights or the like and switches, regulators or the like, by which both the suction power of the blower 3 and a lighting unit 8 can be controlled and dimmed respectively.

Upstream of the filter unit 4 is disposed an at least partially air-permeable shield 9. The latter is dimensioned such that a suction gap 10 is left free, through which the air to be suction-extracted and/or purified, which does not penetrate through the shield 9, can pass, in the form of edge suction extraction $P_r$, directly to the filter unit 4. The problem of increased condensate formation, which occurs when a glass pane is used as the screen 6 or inspection hood, is largely avoided by this edge suction extraction and the accompanying increased flow velocity of the air sucked in and/or to be purified. In addition, due to the high flow velocity of the air sucked in and/or to be purified in the edge region, the fumes possibly located there are sucked in a channeled manner. Optionally, a suction gap filter 15 can be provided in the suction gap 10 to filter the air that passes through the suction gap 10.

A prefilter unit 11 is additionally disposed in the shield 9. Preferably, the prefilter unit 11 used is at least one whirling stream filter in the form of a cyclone filter or of a labyrinth filter. The operation of a cyclone filter, in particular of what is known as the X-cyclone filter, is based on the fact that, by flow guide walls, vortices are generated, by which the grease droplets are thrown onto the guide walls, the air being cleaned of grease droplets. A similar behavior is found in baffle or labyrinth filters which sharply deflect the air flowing through and at the same time build up compressions and expansions, that is to say velocity variations in the flow, and thereby bring about a separation of the grease droplets. In the case of an expanded-metal filter or else in the case of a non-woven filter, fibers and expanded-metal wires are disposed so as to be slightly offset one behind the other, so that the air has to wind its way through around the wires/fibers disposed one behind the other, and grease droplets contained in the air cannot negotiate these deflections on account of the increased inertia and therefore are caught on the wires or fibers and are separated. This prepurification brought about by the prefilter unit 11 due to the suction of a part stream $P_h$ consequently lengthens the maintenance intervals of the filter unit 4. Ideally, the filter unit 4, the prefilter unit 11 and the screen 6 can easily be released from their position, thus making it easier for them to be exchanged or else to be cleaned. The filters 4, 11 are produced from high-grade steel and, after an interval of use has elapsed, can also be cleaned in a conventional dishwasher in order to remove the adhering impurities. This advantageously avoids the need for waste and for transport trips or customer service involvement during maintenance.

Figure 2:
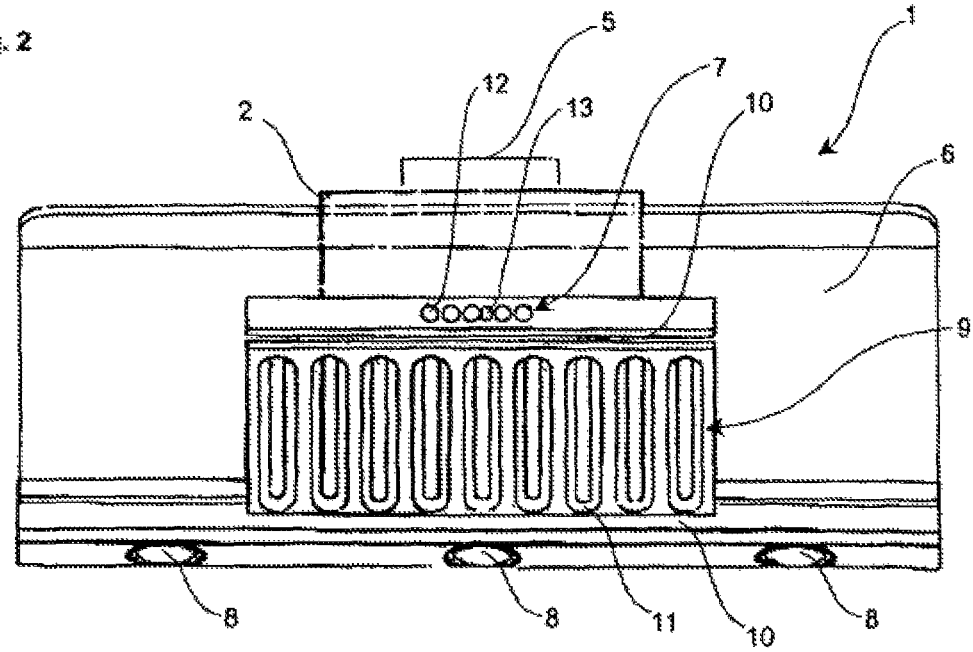
FIG. 2 is a front-elevational view of the extraction hood.

FIG. 2 shows a sketched illustration of a front view of the extraction hood 1 according to the invention, similar to the illustration of FIG. 1. Identical elements and functional blocks are given the same reference symbols hereafter in order to simplify the description. It can be seen in FIG. 2 that an oblique position of the shield 9 gives a view of the prefilter unit 11, as a result of which, in addition to the technical functionality of the extraction hood 1 according to the invention due to the selection of particular materials or forms, an esthetic component is afforded by a visually pleasing configuration. By the selection of particular materials or forms for the screen 6 and/or the control elements 7 with a switch and/or regulator 12, pilot light and warning light 13, and due to a particular arrangement of the lighting unit 8, the user friendliness of the extraction hood 1 is further increased and its functionality emphasized. The extraction hood 1 according to the invention is thereby provided, which, in the configuration illustrated here, has a shield 9 allowing edge suction extraction, the surface of the shield 9 being utilized, using the prefilter unit 11 itself as a filter surface. The at least partially visible filter technology, in the form of the double filter system according to the invention formed of the prefilter unit 11 with whirling stream technology having edge suction extraction and with the following main filter or filter unit 4 formed of expanded metal, is utilized as an element with a configuration effect, so that, according to the invention, the extraction hood 1 is provided which associates a visually pleasing configuration with improved filter technology. A pivotability, implemented in an invention development not illustrated in any more detail, of the screen 6, at least together with the prefilter unit 11, increases headroom, already indicated by the oblique position of the components according to FIG. 2, for example, during cooking, even directly above a cooking point.

We claim:

1. An extraction hood for suction extraction and/or purification of a carrier substance, contaminated with solid and/or liquid substances, the extraction hood comprising:

a housing having at least one inlet and one outlet orifice;

a conveying device for conveying the carrier substance through said housing and having an adjustable conveying power;

a filter unit spaced upstream from the conveying device, and through which the carrier substance flows; and a prefilter unit disposed upstream of said filter unit on a suction side and through which at least a portion of the carrier substance flows, wherein said prefilter unit defines an at least partially peripheral suction gap that increases flow velocity and reduces condensation at the at least partially peripheral suction gap, wherein carrier substance passing through the at least partial suction gap, by-passes the prefilter unit.

2. The extraction hood according to claim 1, wherein said prefilter unit comprises a whirling stream filter selected from the group consisting of cyclone filters, labyrinth filters and baffle filters.

3. The extraction hood according to claim 1, wherein a permeability of said prefilter unit to the carrier substance is adjustable.

4. The extraction hood according to claim 1, wherein a through flow quantity of the carrier substance through said prefilter unit can be adjusted by said conveying device.

5. The extraction hood according to claim 1, wherein a quantity of the carrier substance flowing through said suction gap is regulated by varying a suction gap width of said suction gap.

6. The extraction hood according to claim 1, further comprising a suction gap filter disposed in said suction gap.

7. The extraction hood according to claim 1, wherein permeability of said prefilter unit to the carrier substance varies over different regions of said prefilter unit.

8. The extraction hood according to claim 1, further comprising a screen serving for enlarging an intake region and disposed on said housing.

9. The extraction hood according to claim 8, wherein said screen is at least partially formed of a transparent material.

10. The extraction hood according to claim 8, further comprising at least one lighting unit integrated into at least one of said screen, said housing, said filter unit and said prefilter unit.

11. The extraction hood according to claim 10, wherein said lighting unit can be dimmed.

12. The extraction hood according to claim 8, wherein at least one of said screen, said filter unit and said prefilter unit is disposed at an oblique angle to a rear side of said housing or a rear wall of said housing.

13. The extraction hood according to claim 12, wherein at least one of said screen, said filter unit and said prefilter unit is configured to be capable of being deflected out of a horizontal position.

14. The extraction hood according to claim 8, wherein said screen, said filter unit and/or said prefilter unit can easily be removed for cleaning or for exchange.

15. The extraction hood according to claim 8, wherein said conveying device is integrated in said housing.

16. The extraction hood according to claim 1, wherein a waste-air or circulating-air operation is made possible by adapting said outlet orifice to a waste-air or circulating-air position, respectively.

17. The extraction hood according to claim 7, further comprising a detector selected from the group consisting of sensors and measuring detectors for deriving a degree of pollution or of saturation of said filter unit, of said prefilter unit and/or of said filter in said suction gap, said detector signaling results at least one of optically and acoustically.

18. The extraction hood according to claim 17, wherein a signal from said detector optically and/or acoustically signals fault free operation, a maintenance interval and/or a functional impairment.

19. The extraction hood according to claim 4, wherein said conveying device is a blower.

20. The extraction hood according to claim 10, wherein said lighting unit includes a halogen emitter.

21. The extraction hood according to claim 15, wherein said conveying device is a blower.

22. The extraction hood according to claim 15, wherein said conveying device is disposed external to said housing.

23. The extraction hood according to claim 9, wherein said transparent material is glass.

24. The extraction hood according to claim 9, wherein the carrier substance is cooking vapor.

25. An extraction hood comprising:

a housing having an inlet orifice and an outlet orifice;

a blower within the housing and generating an air flow through the housing, the inlet orifice receiving the air flow into the housing and the outlet orifice discharging the air flow out of the housing;

a screen disposed along a face of the housing and extending outwardly from the housing, the screen at least partially defining the inlet orifice and at least partially directing air flow toward the inlet orifice;

a filter disposed within the inlet orifice separate and upstream from the blower and filtering the air flow;

a prefilter unit adjacent the inlet orifice upstream and spaced from the filter, the prefilter unit having a plurality of passages through which a first portion of the air flow flows; and a suction gap extending along an edge of the prefilter unit and permitting a second portion of the air flow entering the inlet orifice to bypass the prefilter unit, such that condensation is reduced at the suction gap, wherein the sum of the first portion and the second portion is equal to all of the air flow entering the inlet orifice.

26. The extraction hood according to claim 25, wherein the suction gap includes an upper gap extending along a upper edge of the prefilter unit and a lower gap extending along a lower edge of the prefilter unit.

27. The extraction hood according to claim 25, wherein the air flow velocity through the suction gap is greater than the air flow velocity through the prefilter unit.

28. The extraction hood according to claim 25, wherein the prefilter unit has a body and the body is permeable such that the first portion of the air flow can flow through the prefilter unit.

* * * * *